US009027572B2

(12) United States Patent
Urrechaga et al.

(10) Patent No.: US 9,027,572 B2
(45) Date of Patent: May 12, 2015

(54) EYELASH CURLER, MASCARA APPLICATOR, MASCARA CONTAINER, AND MASCARA REMOVER

(71) Applicants: Eukeni Urrechaga, Weston, FL (US); Lizette Urrechaga, Weston, FL (US)

(72) Inventors: Eukeni Urrechaga, Weston, FL (US); Lizette Urrechaga, Weston, FL (US)

( * ) Notice: Subject to any disclaimer, the term of this patent is extended or adjusted under 35 U.S.C. 154(b) by 24 days.

(21) Appl. No.: 13/794,750

(22) Filed: Mar. 11, 2013

(65) Prior Publication Data

US 2014/0251359 A1 Sep. 11, 2014

(51) Int. Cl.
*A45D 40/24* (2006.01)
*A45D 40/26* (2006.01)
*A45D 40/00* (2006.01)

(52) U.S. Cl.
CPC ..... *A45D 40/26* (2013.01); *A45D 40/00* (2013.01)

(58) Field of Classification Search
USPC ..... 132/217, 218, 320, 318, 317; 16/430, 16/DIG. 12
See application file for complete search history.

(56) References Cited

U.S. PATENT DOCUMENTS

| | | | | |
|---|---|---|---|---|
| 5,890,499 | A * | 4/1999 | Fuentes et al. | 132/319 |
| 2003/0005941 | A1* | 1/2003 | Iosilevich | 132/53 |
| 2007/0235055 | A1* | 10/2007 | Narvaez | 132/217 |
| 2011/0174328 | A1* | 7/2011 | Cerutti et al. | 132/200 |

* cited by examiner

*Primary Examiner* — Rachel Steitz
(74) *Attorney, Agent, or Firm* — Hoglund & Pamias, PSC; Roberto J. Rios

(57) ABSTRACT

An ergonomic eyelash curler, cosmetic applicator, container, and mascara remover compromising of a grip type device with anatomical features and a fixed ellipsoid curvature tongue at one end. The tongue and grip are shaped to fit the anatomy of the hand to allow free movement of the thumb and index fingers. This device has an ergonomic design that optimizes human wellbeing and overall hand coordination allowing the user to apply precise and natural motion when beautifying and maintaining the eyelashes. The thumb's tactile sense allows the user to apply measured pressure on the eyelash against the curling edge to provide a prolonged and continuous curvature of the eyelash. The thumb and index finger tactile sense allows the user to effectively remove mascara from the eyelash without irritating the eye area. Multiple eyelash beautifying and maintenance functions can be performed with this invention including mascara application.

12 Claims, 6 Drawing Sheets

EYELASH CURLER, MASCARA APPLICATOR, MASCARA CONTAINER, AND MASCARA REMOVER

FIELD OF THE INVENTION

The present invention relates to the field of cosmetic devices, and more particular to eyelash curlers, cosmetic applicators, cosmetic receptacles, cosmetic containers, and cosmetic removers.

BACKGROUND OF THE INVENTION

Generally, in order to accentuate the natural curve of the eyelash, multiple devices have been proposed. The majority of the devices use a mechanical clamping jaw apparatuses using indirect force through scissor like or pressing member action. Palmer, U.S. Pat. No. 2,712,317, issued a device with a rubber pad clamping jaw having its rear component guided by spaced vertical shanks of a wire frame. A problem with Palmer is that the increased curvature is only obtained at the segment of the eyelash being clamped. Another problem with this clamping device is that it lacks the sense of touch, which makes difficult to control the applied pressure and can accidentally break, pull or tear the eyelash and may also pinch the eyelid. Another problem with fixed curved clamping devices like Palmer, is that eyelids and eyelashes curvature differ from one to another, which may impede the device to curve the entire eyelash with the same offset distance from the eyelid. Another problem with scissor type curlers is that uncomfortable pressure is applied on the fingers when using the device. Finally, the device's mechanical parts move in different direction of the actuating hand, which may increase the level of difficulty to manipulate.

Huang, U.S. Pat. No. 5,685,324, issued a device compromised of an U-shaped frame and a mechanical handle actuating a T-shaped pressing member to provide increased curvature. A problem with Huang is also that the increased curvature is only obtained at the segment of the eyelash being clamped by the T-shape pressing member. Similar to Palmer, the increased curvature is only obtained at the segment of the eyelash being clamped and it lacks the sense of touch. Finally, the device's moving parts are difficult to clean and sterilize.

Locke, U.S. Pat. No. 1,692,341, issued a non-mechanical device composed of a handle and flat piece of suitable material that in operation with the thumb and the flat edge the eyelash is curled. The modus operandi is similar as in a curling feather with the dull end of a knife. A problem with Locke is that the device is not ergonomically designed to fit the natural position of the inside of the hand and may result difficult to operate especially for the inexperienced user. Another problem with Locke is that requires the use of a mirror and the use of the left hand for the left eyelash and the right hand for the right eyelash. This may increase the difficulty to operate since the majority of users have mixed handedness or cross dominance, i.e., the ability to do different tasks better with different hands. Finally this device only allows the user to curl the eyelash with a longitudinal movement since only one edge of the device is designed to curl the eyelash.

Narvaez, U.S. Pat. No. 20070235055, uses the curling method of Locke with an approximate 90 degrees horizontal variation of the hand's and thumb's position in reference to the face. The modus operandi is similar as in curling a feather or paper ribbon with the dull end of a knife. A problem with Narvaez is that the hand movements are different when attempting to curl the eyelashes of both eyes with a single hand. This may increase the skillset requirement. Controlling the device may become difficult, especially for the inexperience user. Another problem with Narvaez is that stainless steel cannot be sterilized using conventional microwave sterilizer, which is a common household sterilizing practice nowadays. Finally, a handle with a metal spatula end, where the spatula is substantially rectangular with a length of 1.5 to 2 inches long and a thickness varying from 0.002 to 0.004 inches may be considered a sharp or piercing object.

In general multiple receptacles have been invented to hold mascara and mascara applicators. Gueret, U.S. Pat. No. 5,743,279, issued a packaging unit for a product such as mascara that includes an applicator and a reservoir provided with at least one wiper. The problem with Gueret and other conventional mascara-packaging devices is that these limit the packaging as a reservoir for mascara and a receptacle for applicators.

Conventionally, a cleansing agents such as a cleansing cream or cleansing oil are used in combination with a cotton rounds or tissues to remove mascara. However it has become difficult to effectively remove mascara without spreading excess cleansing and mascara residue around the eye area, increasing the possibility of irritation or infection.

There thus remains the need for an ergonomic device that permits natural and comfortable motion of the hand to produce a prolonged and continuous curvature of the eyelash. There is also a need to provide increased utility in mascara receptacles and mascara applicators. There is also a need for a device to effectively assist in the mascara removal process. In addition, it is essential the integration of eyelash curlers, mascara receptacles, mascara containers, mascara applicators, and mascara removal assistance devices to simplify the eyelashes' cosmetic and maintenance processes and reduce the amount of devices employed.

SUMMARY OF THE INVENTION

The invention relates to an improved eyelash curler device that integrates mascara applicator, mascara receptacle, mascara container and mascara remover utilities. The invention consists of an ergonomic device compromising of a grip with anatomical features and a fixed ellipsoid curvature tongue at one end. The tongue's concave surface and grip are shaped to fit the anatomy of the thumb to allow a smooth travel and rotation of the distal and proximal phalanxes. The molded grip is held primarily by the index and middle fingers. The thumb finger and the curling edge surface of the tongue work as a curling mechanism. The ellipsoid curvature of the tongue allows the entire edge to function as a curling device, since it replicates the anatomy of the thumb. This provides the user a wider range of arm and hand ergonomic positions while optimizing human wellbeing and the overall hand coordination. The device permits the user to apply precise and natural motion when curling the eyelashes. The thumb's tactile sense allows the user to apply measured and controlled pressure on the eyelash against the curling surface providing a prolonged and continuous curvature. The device has no moving parts.

The tongue and grip also function as anatomical handle that may be used to support a mascara brush applicator. In order to have this functionality the user only needs to hold the device in a reverse position from the tongue with the thumb still pressing the concave surface and the index finger pressing the indented grip. For this functionality the device will have a mascara brush incorporated.

The grip's rotund shape also provides the device to become a mascara container receptacle and a mascara reservoir. For this functionality the curling device will be set at one end to function as a handle, cap, and mascara applicator while the remaining grip functions as a mascara container.

This invention also functions as a mascara remover by providing support and maneuverability assistance to remove the mascara in combination with a folded and quilted cotton pad moisten with a cleansing agent. The folded cotton pad, acting as a sleeve or jacket, is inserted in the ellipsoid curvature tongue and with a similar motion as the curling procedure the mascara is removed from the eyelash. The mascara on the upper side of the eyelash is mainly removed when the eyelash is pressed and softly rubbed between the moisten cotton pad and the thumb finger. The mascara on the lower side of the eyelash is mainly removed when the eyelash is pressed and softly rubbed between the moisten cotton pad and the index finger. Different composition cleansing agents can be used under the same procedure.

It is an object of the present invention to provide an eyelash curler that delivers a better, prolonged, continued and accentuated curve of the eyelash.

It is a further object of the present invention to provide an eyelash curler with ergonomic features that avoids uncomfortable hand and arm movements.

It is a further object of the present invention to provide an eyelash curler that fits the natural position of the hand.

It is a further object of the present invention to provide an eyelash curler that allows easy hand manipulation during the eyelash curling procedure.

It is a further object of the present invention to provide an eyelash curler that allows applying controlled pressured to avoid damaging the eyelash during the eyelash curling procedure.

It is a further object of the present invention to provide an eyelash curler that is easy to be used by mixed handedness and ambidextrous users, and even inexperience users.

It is a further object of the present invention to provide an eyelash curler that is simple to fabricate, with no mechanical or moving parts, durable, inexpensive, and easy to clean and sterilize.

It is a further object of the present invention to provide an eyelash curler that also functions as a mascara applicator with an inserted mascara brush at one end.

It is a further object of the present invention to provide an eyelash curler which handle is suitable as a mascara container and mascara applicator receptacle.

It is a further object of the present invention to provide an eyelash curler that can be incorporated to a conventional mascara container as a mascara applicator and cap.

It is a further object of the present invention to provide an eyelash curler that provides support and maneuverability assistance in the mascara removal process in combination with cotton pads and cleansing agents.

It is a further object of the present invention to provide an eyelash curler that includes a mirror like material on the tongue's convex and concave surfaces to reflect a wide and an enlarged image of the eye area respectively.

It is a further object of the present invention to provide an eyelash curler that can perform multiple eyelash beautifying and maintenance processes.

BRIEF DESCRIPTION OF THE DRAWING

For a complete understanding of the present invention and the advantages thereof, reference is now made to the following descriptions to be taken in combination with the accompanying drawings describing specific embodiments of the invention.

DETAILED DESCRIPTION OF THE INVENTION

Figure 1:
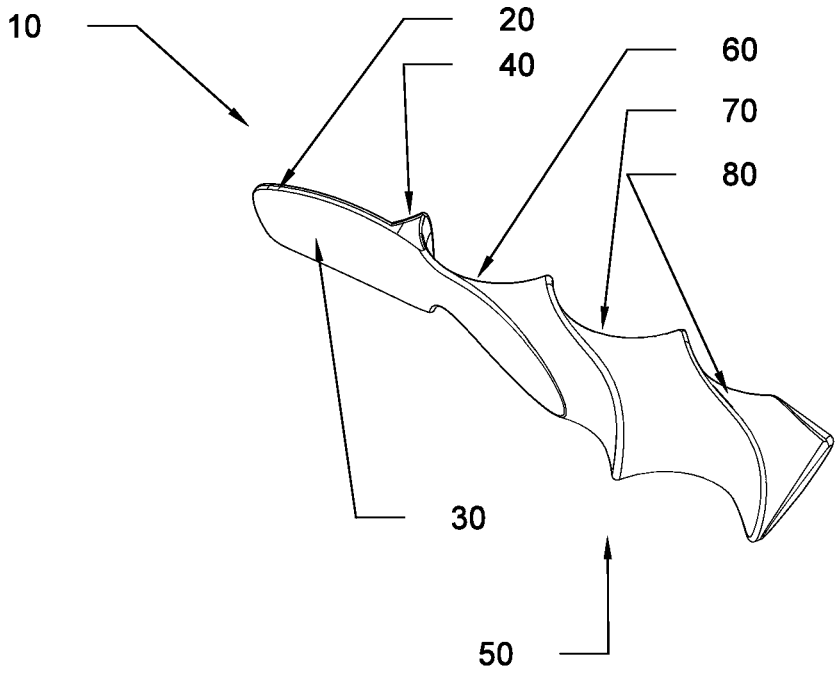
FIG. 1 is a perspective view of a preferred embodiment of the invention showing the tongue's concave side.

Referring to the drawings in general, it will be understood that the illustrations are for the purpose of describing particular implementations of the invention and are not intended to be limited thereof. The drawings are not necessary to scale. It is to be understood that both, the previous general description and the following detail description, are representative and explanatory only, and are not restrictive of the invention, as claimed.

FIG. 1 is an illustration of the present invention as held for immediate use in curling eyelashes. In the preferred embodiment, the device is compromised of a single molded body in a suitable material that forms a handle 50 and a tongue 10. The tongue 10 has an ellipsoidal curvature to form a shallow bowl like shape. The tongue's 10 concave surface 30 allows the user to press the thumb finger against it in a natural manner while the anatomical shaped handle 50 provides a natural grip for at least the index and middle fingers. The dimensions of the tongue 10, handle 50 and finger indentations are proportional to the average hand.

The handle 50 has anatomical finger shape indentations that adapt naturally to the user's index and middle fingers mainly. The finger indentations start at the neck of the tongue 10 and continue along the handle 50. The first finger indentation 40 is located at the convex 130 side of the tongue 10 and it shaped to receive the inner side of the index finger. The second finger indentation 60 is shaped to receive the index finger or the middle finger. The positioning of the index finger in the first finger indentation 40 or second finger indentation 60 is simply a user preference. The third finger indentation 70 is shaped to receive subsequent fingers depending on the user's initial finger positioning. The grip action can be initiated by placing the index finger on the first finger indentation 40 or second finger indentation 60 while the remaining fingers fall into place. In the preferred embodiment an additional indentation 80 is provided for the ring or little finger.

The curling edge 20, which is the edge that meets the tongue's concave surface 30, is semi sharp, which is not completely blunted, nor razor sharp. The thickness of the tongue is not critical for the performance of the invention, however it should be sufficient to resist the bending force applied between the thumb and the index fingers. Thin malleable surfaces are not a necessary composition for this invention to perform as a curling device. The ellipsoid curvature and shape of the tongue 10 adapt to the curvature and shape of the thumb finger for a natural pressing contact. This similarity in curvature and shape allow the curling edge 20 to function as curling device when pressing the thumb finger in different directions.

Figure 2:
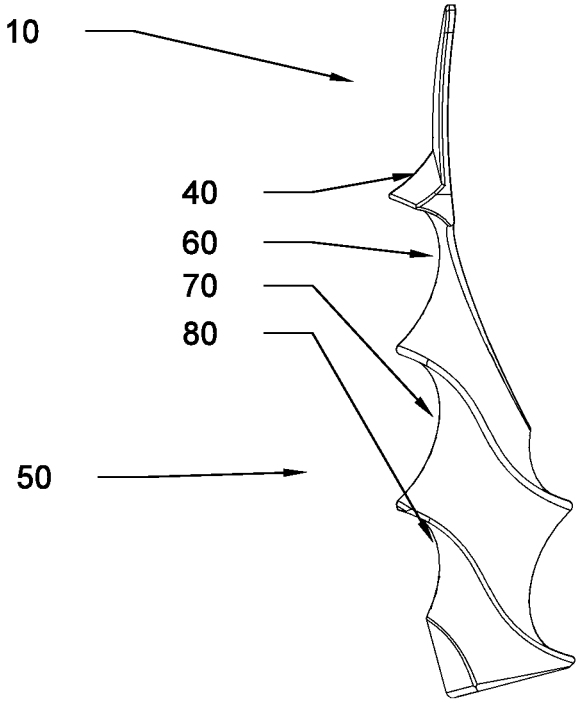
FIG. 2 is a side view of a preferred embodiment of the invention showing the tongue's curvature and the full size grip.

FIG. 2 is an illustration of the present invention as held for immediate use in curling eyelashes. In this illustration the ellipsoidal curvature of the tongue 10 can be better appreciated. This curvature provides a free movement of the thumb's distal and proximal phalanxes along and across the tongue's concave surface 30. The anatomical handle 50 can also be better depicted as well as the first finger indentation 40, second finger indentation 60, third finger indentation 70, and additional finger indentation 80.

This invention can be non metallic and can be disinfected using ordinary sterilizing methods including conventional microwave sterilizers, which are used as a common household sterilizing practice for infant feeding products. Sterilizing cosmetic devices is key to avoid irritation and infection. This invention eases the overall hygiene required to lower the risk of irritation and infection of the eye area.

The invention can include a mirror type material on the convex 130 and concave 30 surfaces of the tongue 10 to reflect a wide and an enlarged image of the eye area respectively. The mirror is not required to operate the device but can provide the user a convenient way to self observe the eye area.

Figure 3:
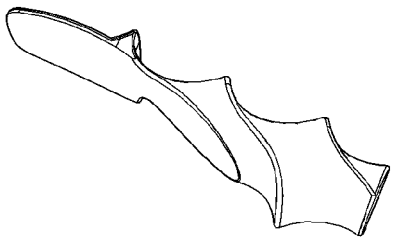
FIG. 3 is a perspective view of a preferred embodiment of the invention showing the tongue's concave side and a compact size grip.

FIG. 3 is an illustration of the present invention as held for immediate use in curling eyelashes similar to the one shown in FIG. 1. This embodiment has a shorter handle.

Figure 4:
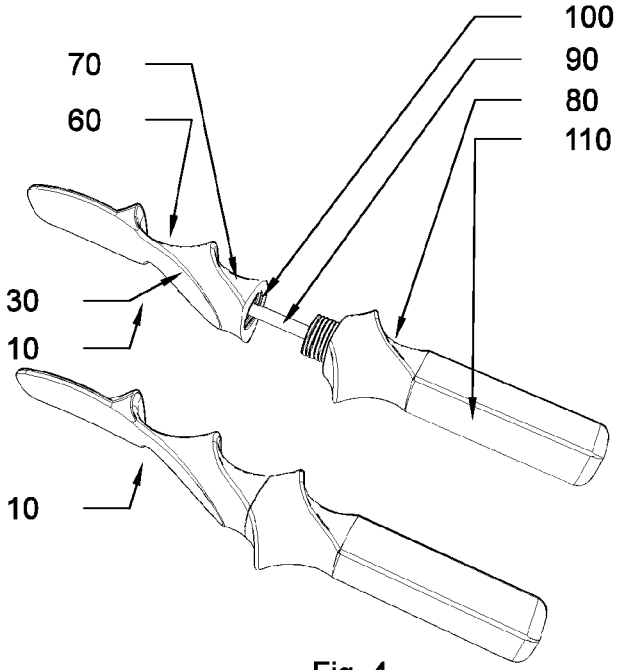
FIG. 4 is a perspective view of a preferred embodiment of the invention showing a variation to provide eyelash curling, mascara applicator, mascara container, and mascara remover utilities.

FIG. 4 is an illustration of the present invention as held for immediate use in curling eyelashes and applying mascara. In addition to the curling functionality already provided by the invention, in this preferred embodiment the handle's 50 rotund shape and hollow core allows the device to become a mascara container 110 while the tongue 10 and part of the handle 50 function as an anatomical grip, container cap 100 and mascara applicator 90.

When not in use the mascara applicator is easily stored inside the mascara container 110 making the device a unified body when stored in closed position.

Figure 5:
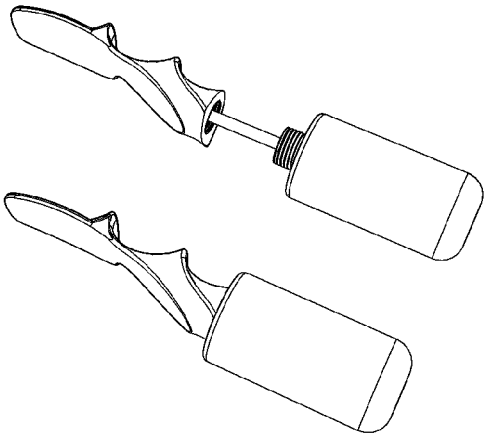
FIG. 5 is a left perspective view of a preferred embodiment of the invention showing a variation to provide eyelash curling, mascara applicator, mascara container, and mascara remover utilities. It also shows how the invention can adapt to a conventional mascara container.

FIG. 5 is an illustration of the present invention as held for immediate use in curling eyelashes and applying mascara. Similar to embodiment shown in FIG. 4, in this preferred embodiment the tongue 10 also functions as an eyelash curler, container cap 100, mascara applicator 90, and mascara remover that can be easily attached to a conventional mascara container. The mascara container shown is just a representation of one commercially available and can vary in size, shape, and length without interfering with the invention's functionality.

Figure 6:
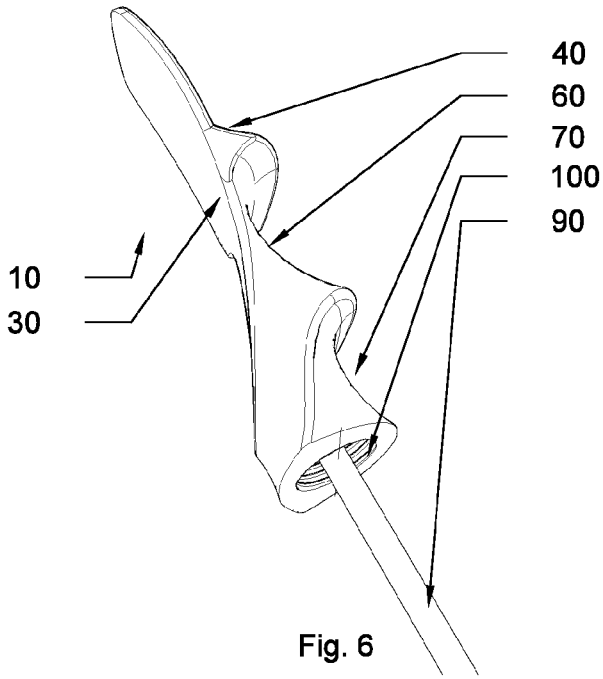
FIG. 6 is a perspective view of a preferred embodiment of the invention showing a variation to provide eyelash curling, mascara applicator, and mascara remover functionalities.

FIG. 6 is an illustration of the present invention as held for immediate use in curling eyelashes and applying mascara. Similar to embodiment shown in FIG. 4 and FIG. 5, in this preferred embodiment the tongue's 10 functions as a container cap 100 and mascara applicator 90 that can be easily attached to a regular and commercially available mascara container.

To handle the device as a mascara applicator, the thumb finger will maintain a pressing contact with the tongue's concave surface 30 in a reverse position while the index finger is positioned in the third finger indentation 70 to hold the tongue 10 firmly. The index finger may also be positioned in the second finger indentation 60 depending on the user's preference and additional fingers may be used to increase the grip strength but is not necessary. The handling of the device is better illustrated in FIG. 15 and FIG. 16. The mascara applicator 90 is inserted in the rotund hollow side of the tongue 10. In this embodiment the rotund hollow side also serves as a threaded mascara container cap 100. This mascara applicator handle can support a wide range of mascara brushes that can vary in shape, size, and pattern.

Figure 7:
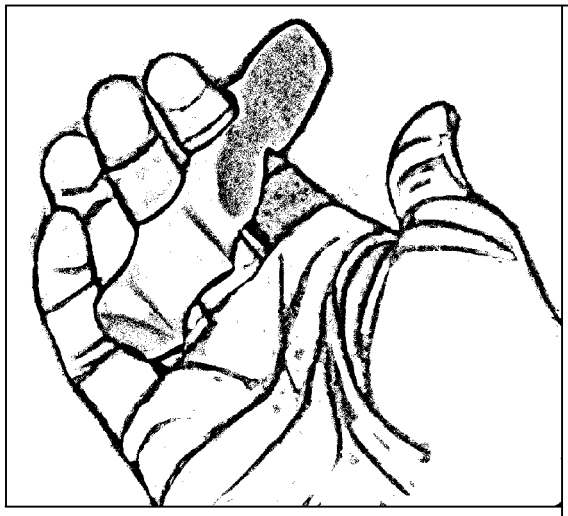
FIG. 7 is a perspective view of a preferred embodiment of the invention; the anatomical shape of the concave tongue and grip allow natural hand placement, manipulation, and operation.

FIG. 7 is an illustration of the present invention as held for immediate use in curling eyelashes. Using the hands in the most natural and neutral position possible can prevent pain from stress injury and help get rid of hand and arm pain from muscle strain or repetitive use. The hand's natural and relaxed position can be observed when dropping the hands to the sides and by looking down it can be seen how the fingers curl slightly toward the palm. This illustration depicts the hand in its natural and relaxed position and how easily the invention falls into place and adjusts to the hand's anatomy. By slightly contracting the hand muscles the user will have a secure grip and still maintain a natural form. The invention besides providing multiple functionalities around the eyelash cosmetic process it is also ergonomic. While the illustration shows a right-handed user, a left-handed user can equally operate the device.

Figure 8:
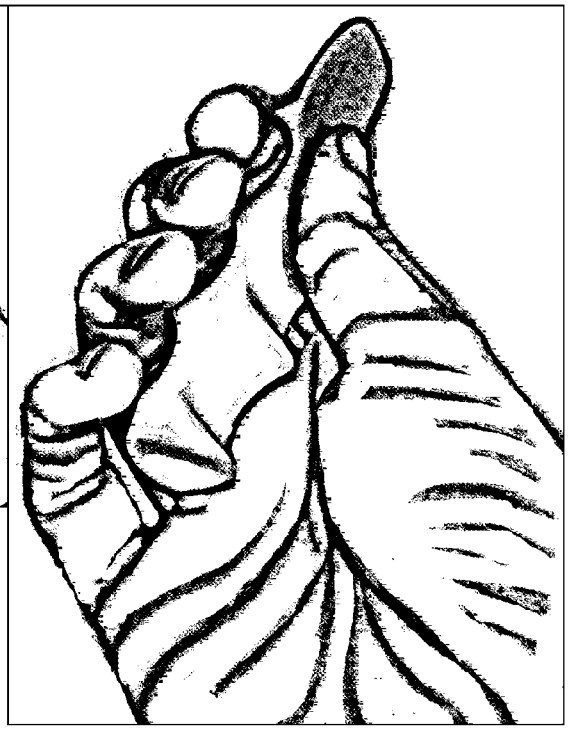
FIG. 8 is a perspective view of a preferred embodiment of the invention; the anatomical shape of the concave tongue and grip allow natural hand placement, manipulation, and operation.

FIG. 8 is an illustration of the present invention as held for immediate use in curling eyelashes. This illustration depicts the hand in a gripping motion starting from a natural position as illustrated in FIG. 7. By slightly contracting the hand muscles the user will start to achieve a secure grip and still maintain a natural form.

Figure 9:
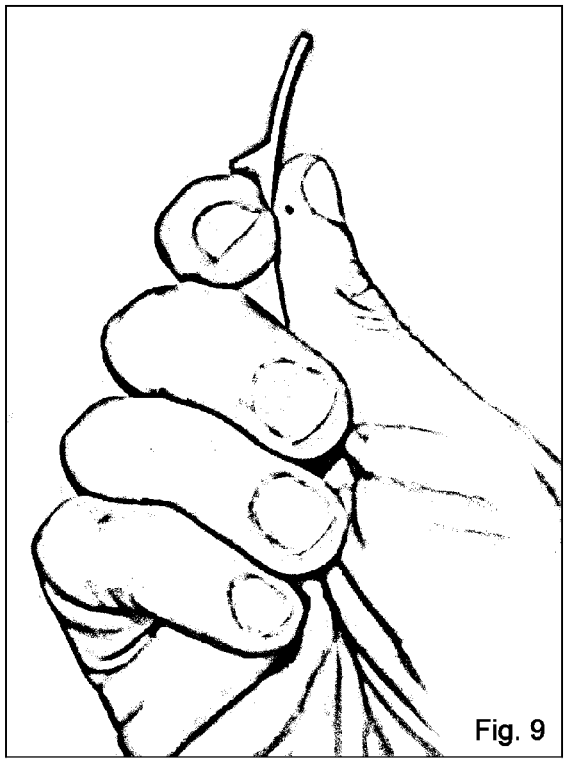
FIG. 9 is a perspective view of a preferred embodiment of the invention; the anatomical shape of the concave tongue and grip allow natural hand placement, manipulation, and operation.

FIG. 9 is an illustration of the present invention as held for immediate use in curling eyelashes. This illustration depicts the hand in secure grip position, which was accomplished with the hand's usual motion starting from a relaxed and natural position as illustrated in FIG. 7 and going through the motion illustrated in FIG. 8. By slightly contracting the hand muscles the user achieves a secure grip and still maintain a natural form.

In this illustration the thumb is positioned against the tongue's 10 concave surface 30 while the index finger is positioned on the second finger indentation 60, the middle finger on the third finger indentation 70, the ring finger on the additional finger indentation 80, and the little finger on the remaining body of the handle 50. The first finger indentation 40 is not used in this illustration but it can be used depending on the users preference by shifting the hand forward one place along the series of indentations.

Figure 10:
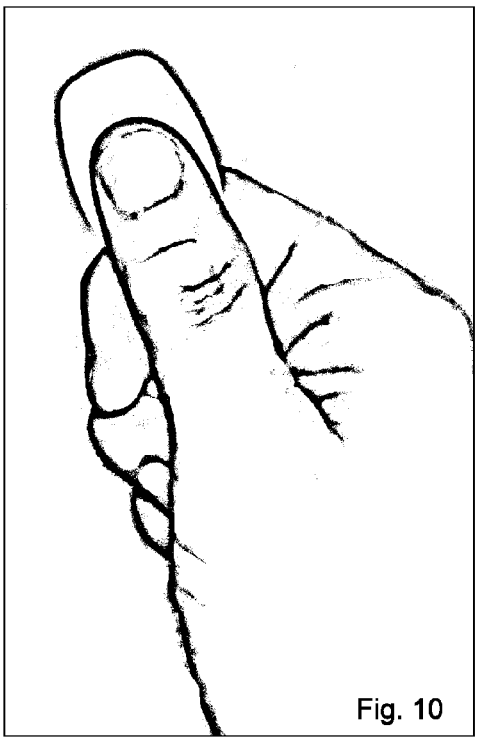
FIG. 10 is a perspective view of a preferred embodiment of the invention; the anatomical shape of the concave tongue and grip allow natural hand placement, manipulation, and operation.

FIG. 10 is an illustration of the present invention as held for immediate use in curling eyelashes. This illustration depicts the hand in secure grip position as shown in FIG. 9 in a different view.

Figure 11:
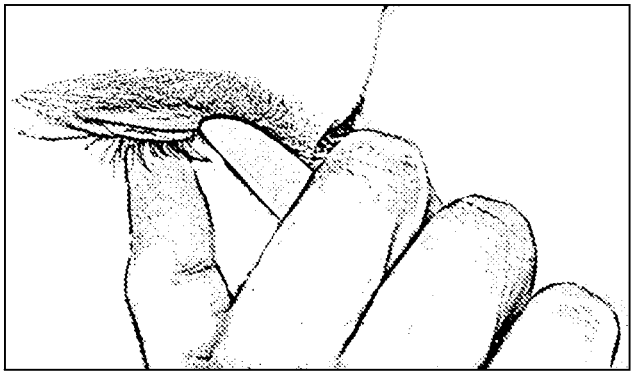
FIG. 11 is a perspective view of a preferred embodiment of the invention illustrating a curling procedure.

FIG. 11 is an illustration of the present invention as held for immediate use in curling eyelashes. This illustration depicts the user in the eyelash curling process. The curling process starts by placing the thumb finger just under the eye and resting the eyelash on the thumb. The tongue's 10 curling edge 20 will then clamp the eyelash against the thumb to initiate the curling process. The modus operandi is similar as in curling a feather with the dull end of a knife.

Figure 12:
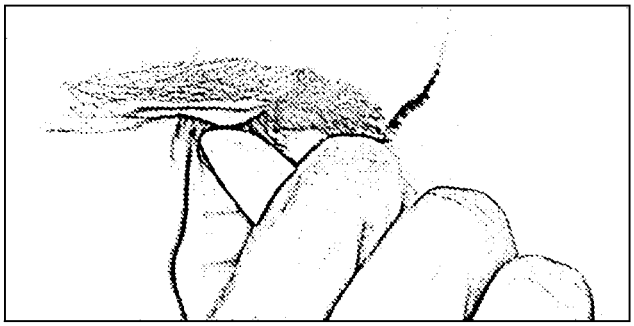
FIG. 12 is a perspective view of a preferred embodiment of the invention illustrating a curling procedure.

FIG. 12 is an illustration of the present invention as held for immediate use in curling eyelashes. This illustration depicts the user in the eyelash curling process. Once the eyelash is clamped as shown in FIG. 11 between the curling edge 20 and the thumb, the curling edge 20 travels away from the eye. While the curling edge 20 maintains pressure over the eyelash against the thumb, it also travels along the distal phalanx curling the eyelash in an accentuated, prolonged and continued manner.

Figure 13:
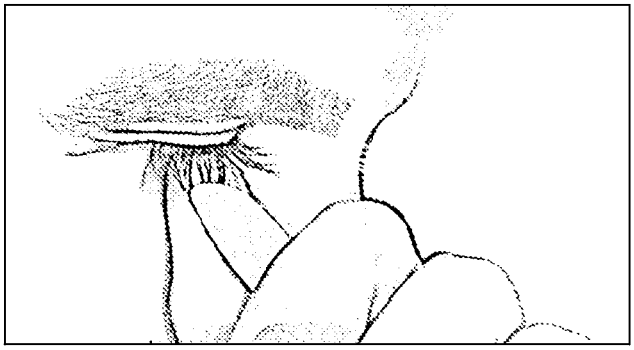
FIG. 13 is a perspective view of a preferred embodiment of the invention illustrating a curling procedure.

FIG. 13 is an illustration of the present invention as held for immediate use in curling eyelashes. This illustration depicts the user completing the eyelash curling process that starts as illustrated in FIG. 11 and continues as illustrated in FIG. 12. While the illustration shows a right-handed user curling the right eye eyelash, the left eyelash can be curled by the same right hand. Reciprocally a left-handed user or an ambidextrous person can equally operate the device. The tongue's 10 convex 130 and concave 30 mirror like surfaces will give the user a convenient way to self appreciate the curled eyelash.

Figure 14:
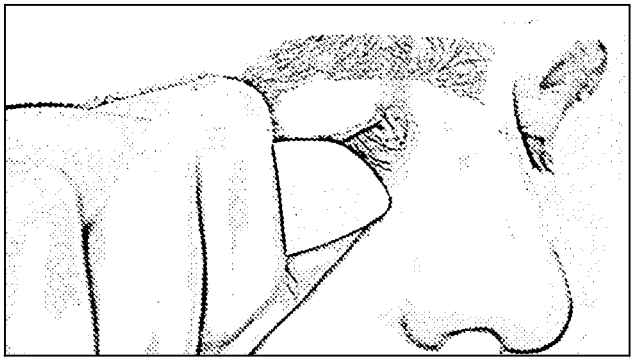
FIG. 14 is a perspective view of a preferred embodiment of the invention illustrating a curling procedure with the hand in sideway position.

FIG. 14 is an illustration of the present invention as held for immediate use in curling eyelashes. This illustration depicts the user in the eyelash curling process in a ninety degrees rotated hand position in reference to the user's face. The eyelash curling process is similar to the procedure given for FIG. 11, FIG. 12, and FIG. 13 with the variation that the traveling motion of the curling edge 20 is across the thumb's distal phalanx and not along it. Again, while the illustration shows a right-handed user curling the right eye's eyelash, the left eyelash can be curled by the same right hand. Reciprocally a left-handed user or an ambidextrous person can equally operate the device.

This invention provides the user a wider range of arm and hand ergonomic positions, which optimizes human wellbeing and the overall hand coordination. The device permits the user to apply precise and natural motion when curling the eyelashes decreasing the problem of breaking and damaging the eyelashes. The thumb's tactile sense also allows the user to apply measured and controlled pressure, which greatly decreases the problem of pulling the eyelash or pinching the eyelid. The end result of this eyelash curler is an eyelash with a prolonged, continuous, and accentuated curvature.

Figure 15:
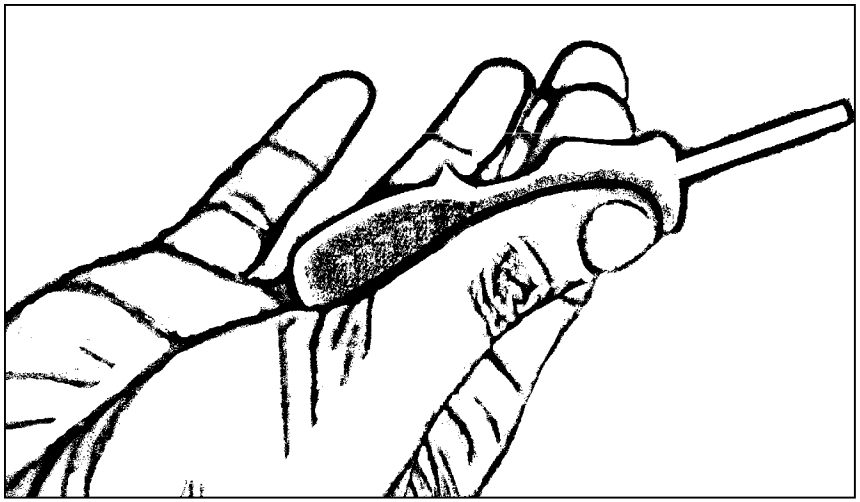
FIG. 15 is a perspective view of a preferred embodiment of the invention illustrating the mascara application utility.
Figure 16:
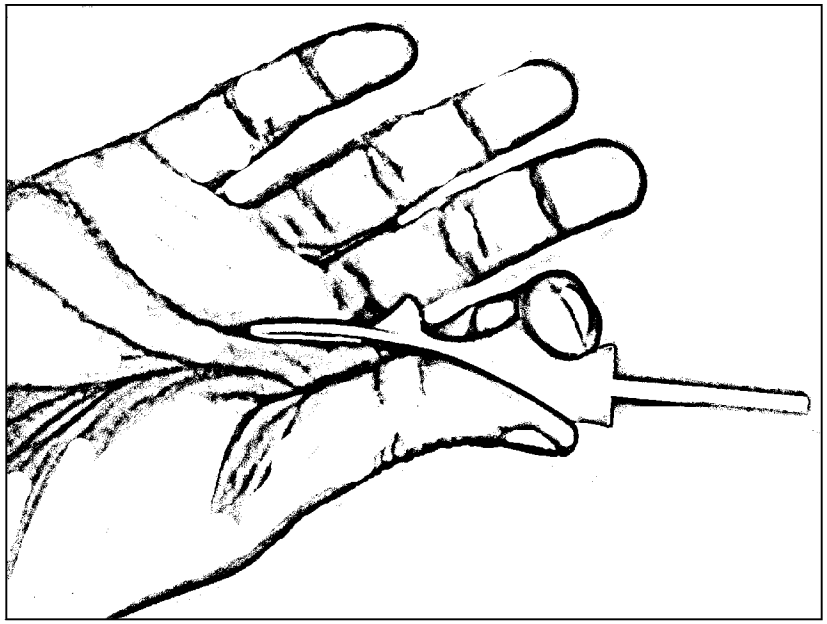
FIG. 16 is a perspective view of a preferred embodiment of the invention illustrating the mascara application utility.

FIG. 15 and FIG. 16 are illustrations of the present invention as held for immediate use in applying mascara. To handle the device as a mascara applicator, the thumb finger will maintain a pressing contact with the tongue's concave surface 30 in a reverse position while the index finger is positioned in the third finger indentation 70 to hold the tongue 10 firmly. The index finger may also be positioned in the second finger indentation 60 depending on the user's preference and additional fingers may be used to increase the grip intensity but is not necessary.

Figure 17:
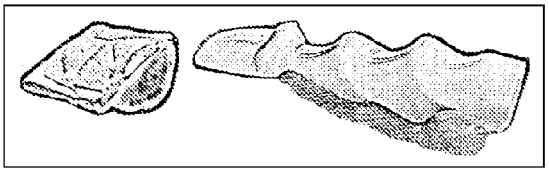
FIG. 17 is a perspective view of a preferred embodiment of the invention illustrating the device as a mascara remover next to a folded and quilted cotton pad.

FIG. 17 is an illustration of the present invention as held for immediate use in removing mascara. This invention in combination with a folded quilted cotton pad 120 and a cleansing agent can effectively remove mascara from the eyelash. This illustration depicts the invention and a folded cotton pad 120 next to it. The cotton pad is quilted to remain in a folded position and act as a sleeve for the invention's tongue 10.

Figure 18:
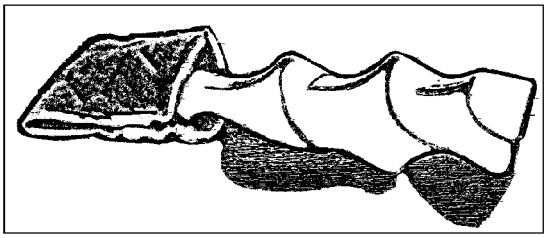
FIG. 18 is a perspective view of a preferred embodiment of the invention illustrating the device as mascara remover. It shows the folded and quilted cotton pad acting as a sleeve for the device's tongue and for immediate mascara removal.

FIG. 18 is an illustration of the present invention as held for immediate use in removing mascara. This illustration depicts the invention with folded cotton pad 120 acting as a sleeve and inserted in the device's tongue 10.

Figure 19:
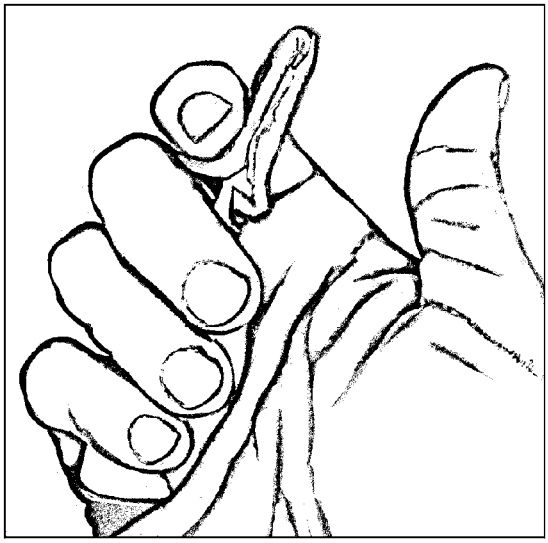
FIG. 19 is a perspective view of a preferred embodiment of the invention illustrating a mascara removal procedure; the tongue's and grip's anatomical shape allow natural hand placement, manipulation, and operation.

FIG. 19 is an illustration of the present invention as held for immediate use in removing mascara. This illustration depicts the invention with folded cotton pad 120 inserted in the device's tongue and held by a right hand user. The thumb finger is positioned close to the covered tongue's concave surface 30 to provide a clamping action while the index finger is positioned on the tongue's 10 covered convex 130 side to provide a similar clamping action. The dual clamping action will allow the user to remove the mascara on the lower and upper side of the eyelash effectively. The middle finger is positioned on the second finger indentation 60, the ring finger in the third finger indentation 70, and the little finger on the third finger indentation 80. The mascara removal procedure is similar to the procedure used to curl the eyelash with the variation that the eyelash can be clamped also by the index finger against the tongue's 10 convex 130 side and a rubbing motion may be incorporated.

Figure 20:
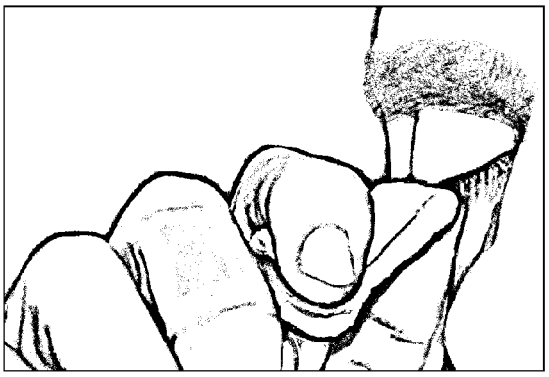
FIG. 20 is a perspective view of a preferred embodiment of the invention illustrating a mascara removal procedure; the tongue's and grip's anatomical shape allow natural hand placement, manipulation, and operation.

FIG. 20 is an illustration of the present invention as held for immediate use in removing mascara. This illustration depicts the invention with a folded cotton pad 120 inserted in the device's tongue 10 and held by a right hand user. At this point the folded cotton pad 120 should be moisten with a mascara-cleansing agent. The mascara removing process starts by placing the thumb finger just under the eye and resting the eyelash on the thumb. The curling edge 20 and concave surface 30 covered with the folded cotton pad 120 will then clamp the eyelash against the thumb to initiate the mascara removal process. This position is mainly to remove the mascara on the upper side of the eyelash. Once the eyelash is clamped between folded cotton pad 120 and the thumb, the moisten cotton surface will travel away from the eye with a slightly rubbing motion. While the moisten cotton surface maintains pressure over the eyelash against the thumb, it also travels along the distal phalanx removing and capturing the mascara located mainly in the upper side of the eyelash. During this process the index finger will keep the folded cotton pad 120 firmly attached to the device by pressing the cotton pad 120 against the first finger indentation 40.

Figure 21:
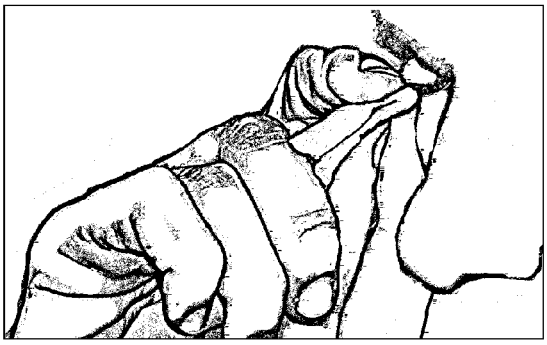
FIG. 21 is a perspective view of a preferred embodiment of the invention illustrating a mascara removal procedure; the tongue's and grip's anatomical shape allow natural hand placement, manipulation, and operation.

FIG. 21 is an illustration of the present invention as held for immediate use in removing mascara. This illustration depicts the continuation of the mascara removing process, which focuses in removing the mascara located mainly in the lower side of the eyelash. The process continues by placing the index finger just above the eyelash. The tongue's 10 convex 130 side covered with the folded cotton pad 120 will then clamp the eyelash against the index finger to remove the remaining mascara on the lower side of the eyelash. Once the eyelash is clamped between the folded cotton pad 120 and the index finger, the moisten cotton surface will travel away from the eye with a slightly rubbing motion. While the moisten cotton surface maintains pressure over the eyelash against the index finger, it also travels across the index finger removing and capturing the mascara located in the lower side of the eyelash. During this process the thumb finger will keep the folded cotton pad 120 firmly attached to the device by pressing the cotton pad 120 against the tongue's 10 concave surface 30. The process detailed for FIG. 21 and FIG. 22 can be inverted to remove first the mascara located on the lower side eyelash and subsequently the mascara on the upper side of the eyelash.

While the embodiments of the present invention have been showed as described, various alterations can be made without deviating from intended utility; and all such modifications are intended to be covered within this patent.

What is claimed:

1. An eyelash curling, eyelash cosmetic applicator, container, and eyelash cosmetic remover device comprising:

a grip with anatomical shape and a fixed ellipsoid curvature tongue at one end, said fixed ellipsoid curvature tongue having a convex surface and a concave surface, said concave surface extending into said grip and adapted to the anatomy of the distal and proximal phalanxes of said thumb, providing the thumb free movement along and across the tongue and the grip to engage the eyelash;

where said tongue and a portion of the grip function as a cosmetic brush applicator by holding the tongue in a reverse position while maintaining the thumb pressed against the concave surface of said tongue and said grip, wherein said cosmetic brush is fixed in a rotund end of said tongue while a remaining portion of the grip comprises a hollow grip acting as a receptacle for the brush applicator.

2. The device of claim 1, further comprising a semi-sharp edge around said concave surface.

3. The device of claim 1, wherein said grip includes finger indentations.

4. The device of claim 1, where a portion of said hollow grip acts as a cosmetic container.

5. The device of claim 1, where a portion of said hollow grip acts as a cosmetic cleansing agent container.

6. The device of claim 1, where a portion of said hollow grip acts as a reservoir.

7. The device of claim 1, where said rotund end of the tongue acts as one of: a cap, lid, plug, or cover for a container.

8. The device of claim 1, where said device has no moving parts.

9. The device of claim 1, where said device is operated with at least one of: the right hand and the left hand.

10. The device of claim 1, where the convex and concave sides of said tongue include a mirror type material that reflects a wide image and an enlarged image of the eye area, respectively.

11. The device of claim 1, further comprising a quilted folded cotton pad and cleansing agents.

12. The device of claim 11, where said quilted folded cotton pad is positioned as a sleeve covering the tongue of said eyelash cosmetic remover device.

* * * * *